US008539978B2

(12) United States Patent
Santinanavat et al.

(10) Patent No.: US 8,539,978 B2
(45) Date of Patent: Sep. 24, 2013

(54) GAS VALVE UNIT WITH BYPASS FLOW

(75) Inventors: Mike Santinanavat, Chesterfield, MO (US); Mark H. Stark, St. Louis, MO (US); Don Blessing, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 105 days.

(21) Appl. No.: 13/099,779

(22) Filed: May 3, 2011

(65) Prior Publication Data

US 2012/0280157 A1 Nov. 8, 2012

(51) Int. Cl.
*F16K 31/02* (2006.01)

(52) U.S. Cl.
USPC ..... 137/601.14; 137/601.15; 137/601.18; 137/601.19; 137/613; 137/833; 137/861; 236/1 E

(58) Field of Classification Search
USPC ..... 137/601.14, 601.15, 601.18, 601.19, 137/613, 883, 861; 165/267; 236/1 E
See application file for complete search history.

(56) References Cited

U.S. PATENT DOCUMENTS

| | | | | |
|---|---|---|---|---|
| 136,746 | A * | 3/1873 | McMahon | 137/204 |
| 1,793,693 | A * | 2/1931 | Hall | 137/601.15 |
| 1,978,737 | A * | 10/1934 | Bower et al. | 361/154 |
| 2,371,351 | A * | 3/1945 | Paille | 137/66 |
| 2,492,859 | A * | 12/1949 | Griswold | 137/601.19 |
| 2,504,435 | A * | 4/1950 | Matteson | 62/212 |
| 2,558,687 | A * | 6/1951 | Krueger | 137/601.19 |
| 2,659,384 | A * | 11/1953 | Lowe | 137/599.18 |
| 2,777,639 | A * | 1/1957 | Grayson | 236/48 R |
| 2,939,524 | A * | 6/1960 | Mathis et al. | 236/99 R |
| 5,062,446 | A | 11/1991 | Anderson | |
| 6,161,535 | A | 12/2000 | Dempsey et al. | 126/110 R |
| 6,283,115 | B1 | 9/2001 | Dempsey et al. | 126/110 R |
| 7,296,595 | B2 | 11/2007 | Santinanavat et al. | 137/614.19 |
| 7,731,096 | B2 | 6/2010 | Lorenz et al. | 236/1 C |
| 7,793,649 | B2 * | 9/2010 | Barkhouse et al. | 126/39 G |
| 8,162,002 | B2 * | 4/2012 | Pavin et al. | 137/613 |

(Continued)

FOREIGN PATENT DOCUMENTS

WO PCT/US12/22400 2/2012

OTHER PUBLICATIONS

U.S. Appl. No. 61/444,956, filed Feb. 21, 2011, Stark et al.
U.S. Appl. No. 13/031,517, filed Feb. 21, 2011, Broker et al.

(Continued)

*Primary Examiner* — John K Fristoe, Jr.
*Assistant Examiner* — Minh Le
(74) *Attorney, Agent, or Firm* — Harness, Dickey & Pierce, P.L.C.

(57) ABSTRACT

A valve unit for adjusting gas flow to a combustion apparatus includes a valve member that moves relative to a valve seat in response to a signal input to a coil, for varying a high-capacity gas flow rate through the valve unit. The valve unit includes a first opening port, a second opening port that is smaller than the first opening port, and a closure member. The closure member is movable between an open position, in which said high-capacity gas flow rate is communicated via the first and second opening ports to an outlet, and a closed position against the first opening port, in which a low-capacity gas flow rate is communicated via only the second opening port to the outlet. The valve unit includes a solenoid for selectively moving the closure member between the open position and closed position to selectively establish a high-capacity gas flow rate or low capacity gas flow rate.

22 Claims, 5 Drawing Sheets

(56) References Cited

U.S. PATENT DOCUMENTS

| | | | | |
|---|---|---|---|---|
| 2006/0016490 | A1* | 1/2006 | Kytola | 137/601.19 |
| 2008/0297288 | A1 | 12/2008 | Irwin | |
| 2010/0009303 | A1 | 1/2010 | Santinanavat et al. | 431/12 |
| 2010/0179700 | A1* | 7/2010 | Lorenz et al. | 700/282 |

OTHER PUBLICATIONS

"MAXITROL—EXA Valve Series Operating Instructions", www.maxitrol.com; 2009; pp. 1-4.

* cited by examiner

GAS VALVE UNIT WITH BYPASS FLOW

FIELD OF THE INVENTION

The present disclosure relates to systems for control of a gas fired appliance having a gas valve, and more particularly relates to gas valves for control of gas flow to such an appliance.

BACKGROUND

The statements in this section merely provide background information related to the present disclosure and may not constitute prior art.

Gas-fired heating units or furnaces that operate at two or more gas flow rates are generally referred to as multistage furnaces. Multistage furnaces are frequently selected by homeowners over single stage furnaces because they offer increased performance and comfort by varying the level of heating output as needed. In many multistage furnaces, a furnace control may be configured to request operation of a gas valve at a desired operating capacity level or gas flow rate. The operating capacity level requested by such furnace controls could be as low as 30 percent of full capacity gas flow operation. However, at low capacity gas flow rates, such gas valves are not capable of controllably maintaining the gas flow rate within a desired tolerance, and therefore are not utilized at such low capacity levels. Accordingly, a need still exists for an improved valve unit and associated control for present two stage heating systems.

SUMMARY

Further areas of applicability will become apparent from the description provided herein. It should be understood that the description and specific examples are intended for purposes of illustration only and are not intended to limit the scope of the present disclosure.

Various embodiments are provided of a valve unit for a heating or combustion apparatus. One embodiment of a valve unit includes a valve member that moves relative to a valve seat in response to a signal input to a coil, for varying a high-capacity gas flow rate through the valve unit. The valve unit includes a first opening port, a second opening port that is smaller than the first opening port, and a closure member. The closure member is movable between an open position, in which said high-capacity gas flow rate is communicated via the first and second opening ports to at least one outlet, and a closed position against the first opening port, in which a low-capacity gas flow rate is communicated via only the second opening port to the at least one outlet. The valve unit includes a solenoid for selectively moving the closure member between the open and closed positions, to respectively selectively establish a high-capacity gas flow rate or low capacity gas flow rate to at least one outlet.

According to another aspect of the present disclosure, various embodiments of a valve unit are provided that are configured to control the signal that is input to the coil to adjust the gas flow rate through the valve seat to a desired gas flow rate. In some embodiments, the coil is part of a stepper-motor that displaces the valve member based on an input voltage applied to the stepper-motor coil, where the valve member is configured to displace a diaphragm to vary the gas flow rate through the valve unit. In other embodiments, the coil is a solenoid coil that is configured to move the valve member to vary the high-capacity gas flow rate based on the magnetic field generated by the coil, where the magnetic field is dependent on the input voltage.

Further areas of applicability will become apparent from the description provided herein. The description and specific examples provided in this summary are intended for purposes of illustration only and are not intended to limit the scope of the disclosure.

DRAWINGS

The drawings described herein are for illustration purposes only and are not intended to limit the scope of the present disclosure in any way.

Corresponding reference numerals indicate corresponding parts throughout the several views of the drawings.

DETAILED DESCRIPTION

Figure 1:
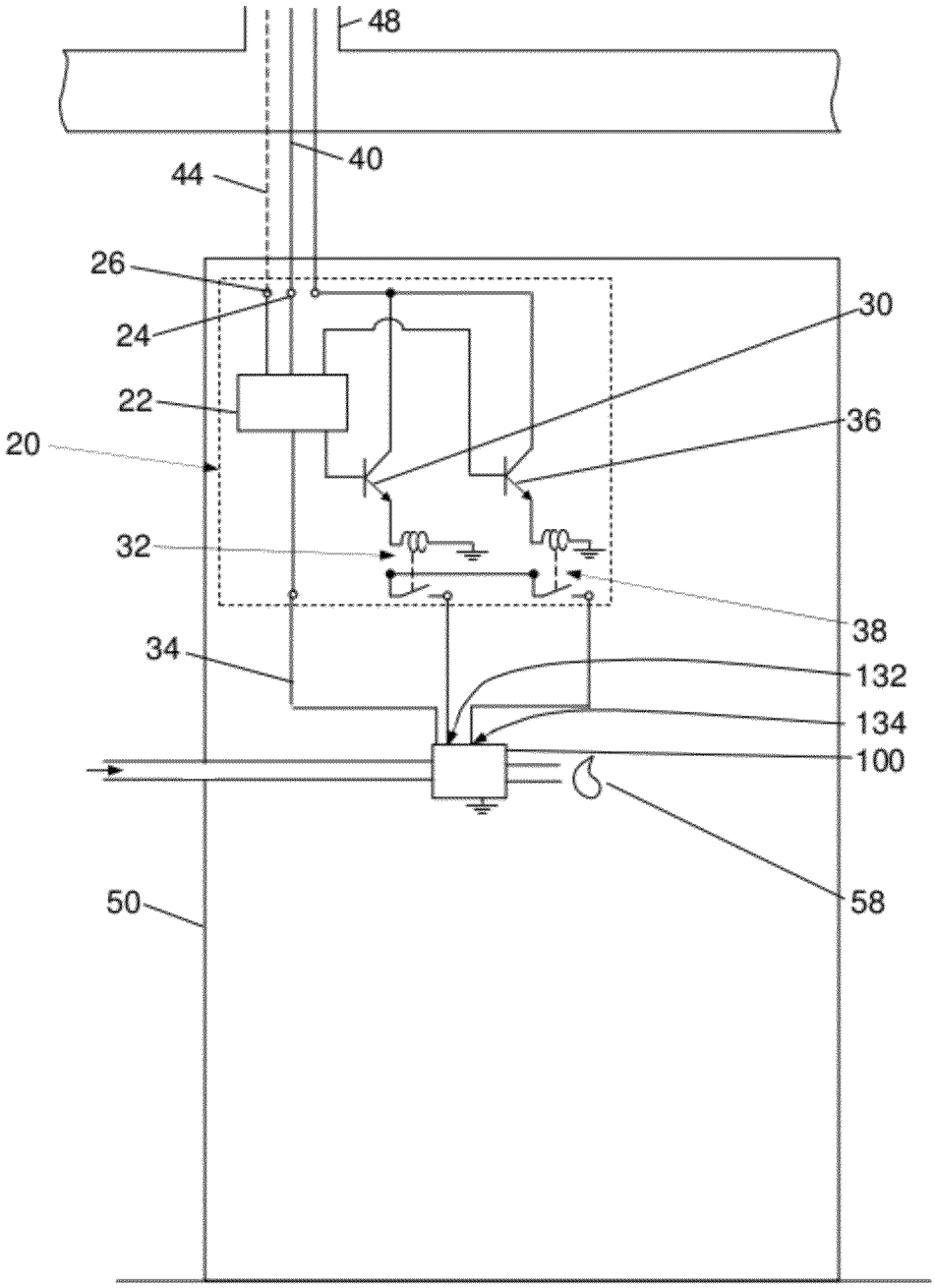
FIG. 1 depicts a schematic diagram of a variable heating system controller, shown within a heating apparatus that includes a valve unit.

The following description is merely exemplary in nature and is not intended to limit the present disclosure, application, or uses. It should be understood that throughout the drawings, corresponding reference numerals indicate like or corresponding parts and features.

Various embodiments are provided of a valve unit for a heating or combustion apparatus. One embodiment of a valve unit includes a valve member that moves relative to a valve seat in response to a signal input to a coil, for varying a high-capacity gas flow rate through the valve unit. The valve unit includes a first opening port, a second opening port that is smaller than the first opening port, and a closure member. The closure member is movable between an open position, in which said high-capacity gas flow rate is communicated via the first and second opening ports to an outlet, and a closed position against the first opening port, in which a low-capacity gas flow rate is communicated via only the second opening port to the outlet. The valve unit includes a solenoid for selectively moving the closure member between the open position and closed position to selectively establish a high-capacity gas flow rate or low capacity gas flow rate, respectively, to the outlet.

According to another aspect of the present disclosure, various embodiments of a valve unit are provided that are configured to control the signal that is input to the coil to adjust the gas flow rate through the valve seat to a desired gas flow rate. In some embodiments, the coil is part of a stepper-motor that displaces the valve member based on an input voltage applied to the stepper-motor coil, where the valve member is configured to displace a diaphragm to vary the gas flow rate through the valve unit. In other embodiments, the coil is a solenoid coil that is configured to move the valve member to vary the high-capacity gas flow rate based on the magnetic field generated by the coil, where the magnetic field is dependent on the input voltage.

The various embodiments of a valve unit are connectable to and operable with a variable heating system controller for a furnace or heating unit, where the variable-heating system controller initiates operation of the heating unit based on input signals from a single-stage, two-stage or other type of thermostat. To better illustrate the operation of the valve unit embodiments, an example of a variable-heating system controller for a heating unit 50 (shown in FIG. 1) is provided for purposes of explanation. The variable-heating system controller 20 includes a microcontroller 22, and a first input terminal 24 for receiving a heat activation signal from a wire 40 connected to a thermostat (e.g., a "W" terminal on the thermostat). The variable-heating system controller 20 may have a second terminal 26 for receiving a low stage heat activation signal where a two-stage thermostat is used and connected via wire 44.

In response to a thermostat activation signal, the variable-heating system controller 20 signals a valve unit 100 to establish gas flow to a burner 58. The variable-heating system controller 20 may be a two-stage controller that is configured to signal the valve unit 100 to establish a low-stage gas flow rate for a predetermined time period, and to thereafter signal the valve unit 100 to establish a high-stage gas flow rate after expiration of the predetermined time period. This may be achieved by a first switching means 30 for switching a voltage source "V" to a relay device 32 that switches voltage to a first connection 132 on the valve unit 100 to establish a low stage gas flow rate, and a second switching means 36 for switching voltage to a relay device 38 that switches voltage to a second connection 134 on the valve unit 100 to establish a high stage full-capacity gas flow rate to the burner 58. Alternatively, the variable-heating system controller 20 may be configured to provide (via wire 34) a pulse-width-modulation or other equivalent signal to the valve unit 100, which indicates a desired operating capacity level. Accordingly, an exemplary variable-heating system controller 20 may be configured to respond to one or more thermostat activation signals by signaling a valve unit 100 to establish a high capacity gas flow rate, a low capacity gas flow rate, or one or more variable gas flow rates therebetween.

Figure 2:
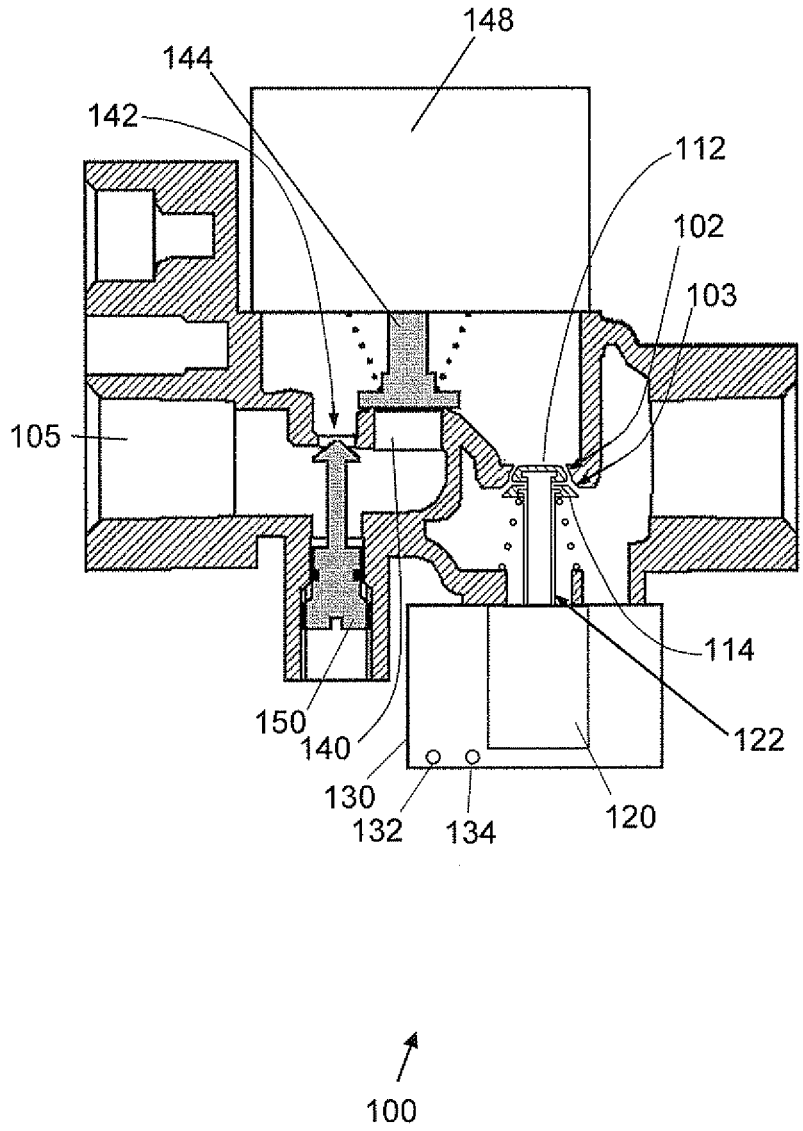
FIG. 2 shows a cross-sectional view of a first embodiment of a valve unit for controlling gas flow within a heating apparatus.

Referring to FIG. 2, one exemplary embodiment is shown of a valve unit 100 for adjusting gas flow rates within a heating unit or combustion apparatus. The valve unit 100 includes a movable valve member 122 for adjusting a gas flow rate. In response to a magnetic field generated by a coil 120, the valve member 122 moves relative to a valve seat 102 to vary a gas flow rate to a valve outlet 105. To vary the gas flow rate, the valve member 122 is configured to move a controlled amount based on a magnetic field that is established by an input voltage applied to a coil 120.

Specifically, the exemplary valve unit 100 in FIG. 2 includes a first valve seat 102, a second valve seat 103 substantially co-aligned with the first valve seat 102, and an outlet 105. The valve unit 100 includes a first valve element 112 that is spaced from the first valve seat 102 when the first valve element 112 is in an open position, and seated against the first valve seat 102 when the first valve element 112 is in a closed position. The valve unit 100 includes a second valve element 114 substantially co-aligned with the first valve element 112 and moveable relative to the second valve seat 103, where the second valve element 114 is spaced from the second valve seat 103 when the second valve element 114 is in an open position, and seated against the second valve seat 103 when the second valve element 114 is in a closed position. The valve unit 100 further includes a valve member 122 that operatively moves the first valve element 112 and second valve element 114 in response to a magnetic field generated by a coil 120. The valve member 122 is configured to move the first and second valve elements 112, 114 relative to at least the second valve seat 103 to vary an opening area therebetween. More preferably, the valve member 122 is configured to move a first distance to pull the first valve element 112 away from a closed position against the first valve seat 102 towards an open position, and to move beyond the first distance to pull the second valve element 114 away from a closed position against the second valve seat 103 and towards an open position. The valve member 122 is configured to move a controlled amount based on the magnetic field generated by the coil 120 to vary the opening area to provide a desired high-capacity gas flow rate through the valve unit 100.

In the various valve unit embodiments of the present disclosure, the function of establishing a select high-capacity gas flow rate or low-capacity gas flow rate may be equivalent to establishing a corresponding select outlet pressure at the outlet 105 of the valve unit 100, as explained below. Specifically, to achieve a desired high-capacity or low-capacity gas flow rate at a downstream location of a burner 58 (as shown in FIG. 1), the various embodiments of a valve unit 100 are configured to adjust an opening area relative to a valve seat (e.g., seats 102, 103 in FIG. 2) to establish an outlet pressure at an outlet 105 that yields the corresponding desired gas flow rate. Table 1 shown below illustrates various exemplary outlet pressure levels that are approximately equivalent to various exemplary gas flow rates, which rates are expressed as a percent of full capacity gas flow for the valve unit 100.

TABLE 1

| Pressure (inches water column) | Capacity (% full capacity flow for Natural Gas) |
|---|---|
| 5.00 | 100 percent |
| 3.60 | 85 percent |
| 1.30 | 50 percent |
| 0.45 | 30 percent |
| 0.20 | 20 percent |

Accordingly, the various valve unit embodiments are configured to control an input to a coil 120 to move a valve member 122 to establish an outlet pressure at the outlet 105 that corresponds to a selected capacity level or gas flow rate. In the exemplary valve unit 100 in FIG. 2, the coil 120 is preferably a solenoid coil that is configured to move the valve member 122 relative to a valve seat (e.g., seats 102, 103) based on a magnitude of the generated magnetic field, which is dependent on an input voltage applied to the coil 120. By controlling the input voltage that is applied to the coil 120 to move the valve member 122, the valve unit 100 can vary the extent of opening area between the first and second valve seats 102, 103 and the first and second valve elements 112, 114. Accordingly, the valve member 122 can vary the opening area between the first and second valve elements 112, 114 and the first and second valve seats 102, 103, to vary the gas flow rate to the outlet 105.

However, when the coil 120 and valve member 122 are operated to adjust the opening area to establish and maintain very low gas flow rates (e.g., at a low outlet pressure of about 1.0 inch of water column or less), the regulation over such low gas flow rates is typically not within a desired tolerance range. To establish such a consistent low capacity gas flow rate, the present exemplary valve unit 100 further includes a first opening port 140, and a second opening port 142 (or bypass orifice). The first and second opening ports 140, 142 are disposed downstream of the valve seat (e.g., seats 102, 103). The valve unit 100 further includes a closure member 144 that is movable between an open position and a closed position relative to the first opening port 140. When the closure member 144 moves to an open position, a high-capacity gas flow rate (set by valve member 122) is communicated to an outlet 105. When the closure member 144 moves to a closed position against the first opening port 140, a low-capacity gas flow rate is communicated via only the second opening port 142 to the valve outlet 105. In the valve unit 100 shown in FIG. 2, the high-capacity gas flow rate is communicated via both the first and second opening ports 140, 142 to the outlet 105, but may alternatively be communicated to two or more outlets, as shown in FIG. 3.

The second opening port 142 (or bypass orifice) preferably has an opening area less than about 0.100 inches$^2$ that is effective to provide a low gas flow rate at a low outlet pressure of about 1.0 inch of water column or less, and to maintain the desired gas flow rate within a tolerance of +/−0.15 inches of water column. More preferably, the second opening port 142 may have a flow adjustment member 150 that is adjustable for varying the opening area of the second opening port 142. The flow adjustment member 150 may comprise a screw or other threaded component that is suitable for impinging or restricting the opening area of the second opening port 142.

The valve unit 100 further includes a solenoid 148 for selectively moving the closure member 144 between the open position and closed position to selectively establish a high-capacity gas flow rate or low capacity gas flow rate, respectively, to the outlet 105. Accordingly, the valve unit 100 includes a coil 120 for adjusting a valve member 122 to vary a high capacity gas flow rate through a valve seat (e.g., seats 102, 103), and a solenoid for selectively communicating either the high capacity gas flow rate or the low capacity gas flow rate to the outlet 105. This function enables the valve unit 100 to provide a desired high capacity gas flow rate to a heating apparatus, as well as a consistent low capacity gas flow rate that is maintained within a desired tolerance range.

Figure 3:
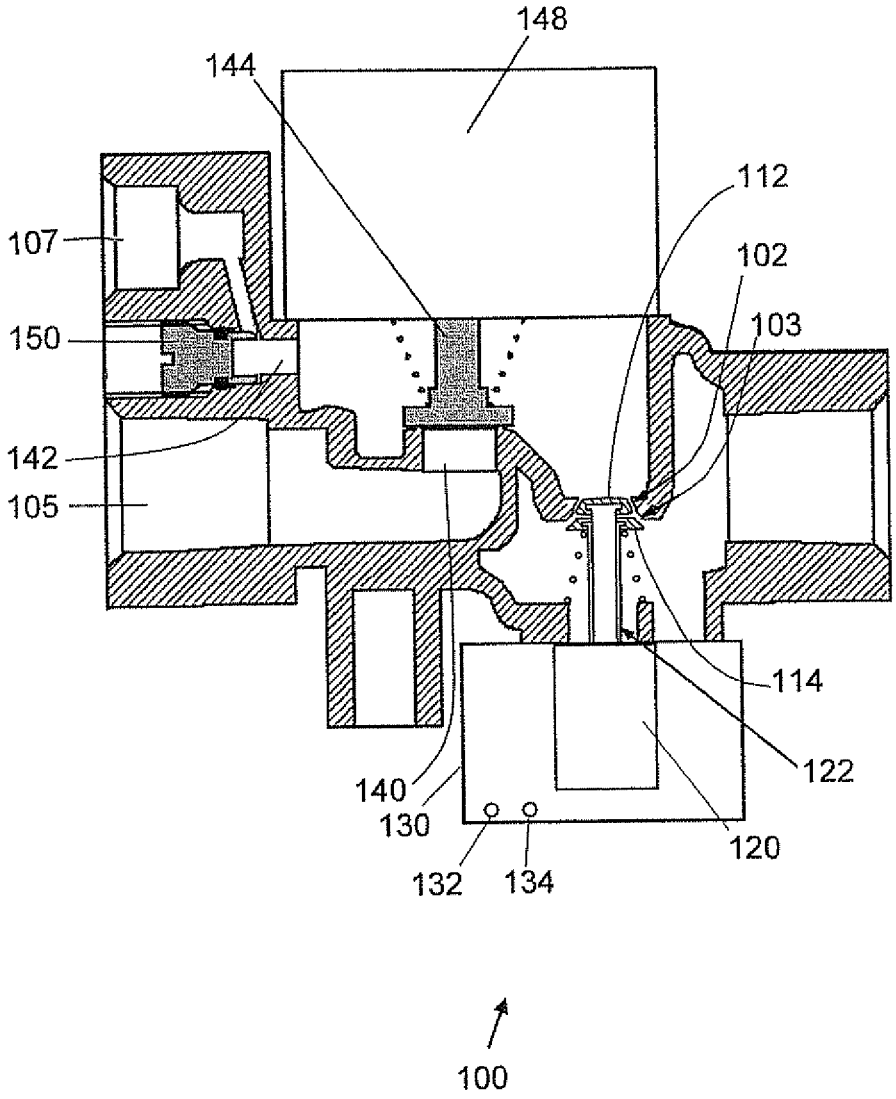
FIG. 3 shows a cross-sectional view of an alternate construction of the first embodiment of a valve unit shown in FIG. 2.

Referring to FIG. 3, an alternate construction of the valve unit 100 is shown. Much like the valve unit 100 in FIG. 2, the alternate construction in FIG. 3 includes a valve member 122 that moves relative to a valve seat (e.g., 102, 103) in response to a signal input to a coil 120 for varying a high-capacity gas flow rate, and first and second opening ports 140, 142' and closure member 144. However, in this alternate construction, the first opening port 140 leads to the outlet 105, and the second opening port 142' leads to a second outlet 107 for communicating a low capacity gas flow rate. The second outlet 107 may communicate low capacity gas flow rate to a pilot burner, for example, and may be adjustable using a flow adjustment member 150 to vary the opening area of the second opening port 142'. Accordingly, the closure member 144 is movable between an open position, in which a high-capacity gas flow rate is communicated via the first opening port 140 to an outlet 105, and a closed position against the first opening port 140, in which a low-capacity gas flow rate is communicated via only the second opening port 142' to the outlet 107. As with the valve unit 100 shown in FIG. 2, the alternate construction also enables the valve unit 100 to provide a desired high capacity gas flow rate to a heating apparatus, as well as a consistent low capacity gas flow rate that is within a desired tolerance range.

In the particular embodiments shown in FIGS. 2-3, the valve unit 100 includes a solenoid operator in which the coil 120 is configured to move the valve element 112 to vary gas flow rate through the valve unit 100 based on the magnetic field generated by the coil 120. The valve member 122 is configured to directly vary an opening area relative to at least one valve seat (e.g., seats 102, 103) to vary the gas flow rate. Accordingly, the valve member 122 is direct-acting, in that it moves in response to an electrical signal to vary an opening area, without any mechanical linkage to a diaphragm for displacing the valve member 122, as in conventional two-stage gas valve devices. The input voltage applied to the solenoid coil 120 is that which provides the desired low-stage gas flow rate and the high-stage full-capacity gas flow rate. However, other embodiments of a valve unit are contemplated in which input to a coil moves a valve member to vary a gas flow rate, as explained below.

Figure 4:
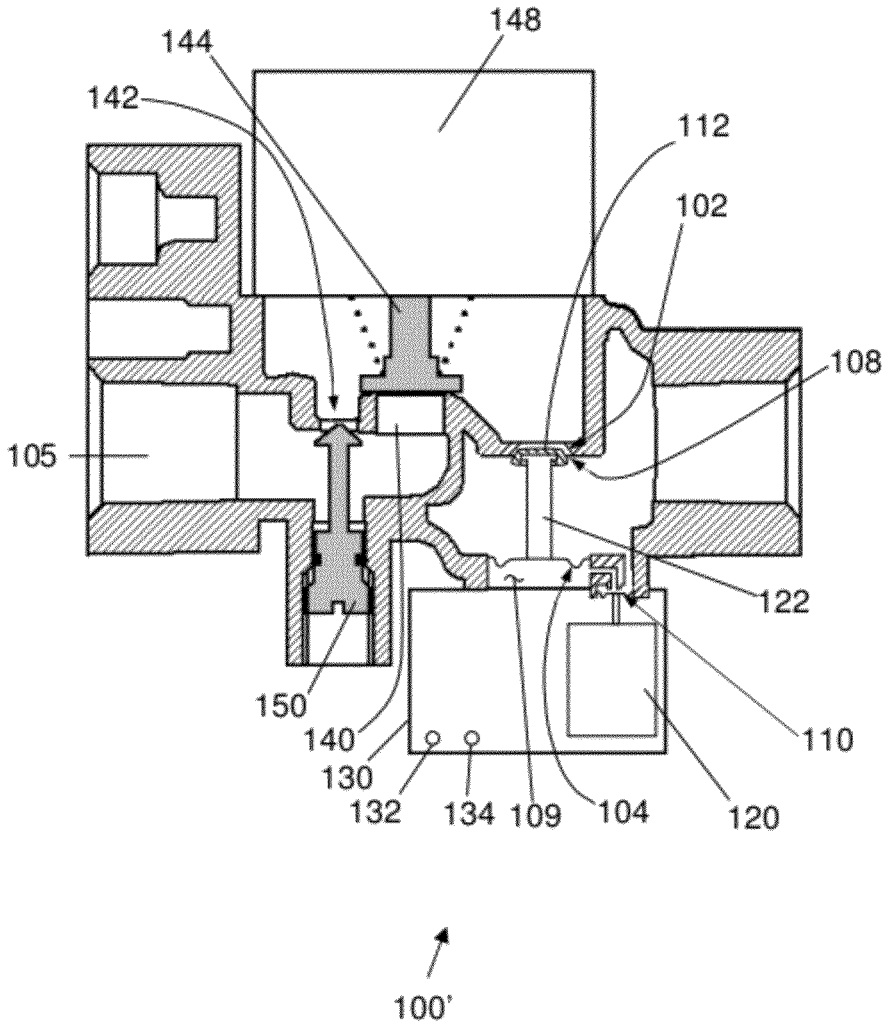
FIG. 4 shows a cross-sectional view of a second embodiment of a valve unit for controlling gas flow within a heating apparatus.

Referring to FIG. 4, a second embodiment of a valve unit 100' is shown in which the coil 120 is part of a stepper-motor that causes a valve member 122 to move based on a voltage applied to the stepper-motor coil 120. The stepper motor operated valve unit 100' includes a main diaphragm chamber 109, and a main diaphragm 104 disposed therein that is coupled to the valve member 122. The main diaphragm 104 controllably displaces the valve member 122 and associated valve element 112 relative to a valve seat 102 to vary an opening area 108 in response to changes in pressure in the main diaphragm chamber 109, to thereby permit adjustment of fuel flow through the valve seat 102. The stepper motor operated valve unit 100' further includes a servo-regulator diaphragm 110, which is configured to regulate fluid flow to the main diaphragm chamber 109. The servo-regulator diaphragm 110 therefore controls the fluid pressure applied to the main diaphragm 104 to move the valve member 122, to control the rate of flow through the valve seat 102. The stepper motor operated valve unit 100' also includes a stepper motor coil 120 configured to move in a stepwise manner to displace the servo-regulator diaphragm 110, and causes the valve member 122 to move and regulate the rate of flow through the valve unit 100'.

The stepper motor coil 120 accordingly provides control over the extent of opening area relative to the valve seat 102, to provide modulated gas flow operation. The stepper motor operated valve unit 100' preferably includes a valve controller 130 that is configured to receive an input signal that is indicative of a desired operating capacity level or gas flow rate from the furnace system controller 20 (shown in FIG. 2). As shown in FIG. 4, the stepper motor operated valve unit 100' drives the stepper motor to move in a step-wise manner, which causes the stepper motor to displace the servo-regulator diaphragm 110 and move the valve member 122 relative to the valve seat 102, to thereby control the rate of fuel flow through the valve seat 102. The valve controller 130 determines the number of steps the stepper motor coil 120 must rotate to move the servo-regulator diaphragm 110 and valve member 122 to establish the requested gas flow rate.

To accommodate low capacity gas flow rates, the valve unit 100' further includes a first opening port 140, and a second opening port 142 that is smaller than the first opening port. The first opening port 140 and the second opening port 142 are disposed downstream of the valve seat 102. The valve unit 100 further includes a closure member 144. The closure member 144 is movable between an open position, in which a high-capacity gas flow rate is communicated via the first and second opening ports 140, 142 to an outlet 105, and a closed position against the first opening port 140, in which a low-capacity gas flow rate is communicated via only the second opening port 142 to the outlet 105. The second opening port 142 preferably has an opening area less than about 0.100 inches$^2$ that is effective to provide a low gas flow rate at a low outlet pressure of about 1.0 inch of water column or less, and to maintain the desired gas flow rate within a tolerance of +/−0.15 inches of water column. More preferably, the second opening port 142 may have a flow adjustment member 150 that is adjustable for varying the opening area of the second opening port 142. The valve unit 100' further includes a closure solenoid 148 for selectively moving the closure member 144 between the open position and closed position to selectively establish a high-capacity gas flow rate or low capacity gas flow rate, respectively, to the outlet 105. Accordingly, the valve unit 100' includes a coil 120 for adjusting a valve member 122 to vary a high capacity gas flow rate through a valve seat 102, and a solenoid for selectively communicating either the high capacity gas flow rate or the low capacity gas flow rate to the outlet 105. This selectivity enables the valve unit 100' to provide a desired high capacity gas flow rate to a heating apparatus, as well as a consistent low capacity gas flow rate that is maintained within a desired tolerance range.

In the above described embodiments, the valve unit 100 includes a valve member 122 that moves in response to a magnetic field generated by a coil 120 to vary a gas flow rate through the valve unit 100, where the coil 120 may be a component of a solenoid or a stepper-motor that causes the displacement of a valve member 122. The various embodiments of a valve unit 100 further include a valve controller 130 for controlling the input to the coil 120 to controllably vary the gas flow rate of the valve unit 100, as explained below.

Operation at High-Capacity Gas Flow Rates

Referring back to FIGS. 2-4, the valve unit 100 includes a valve controller 130 that is configured to control input to the coil 120. As stated, the valve unit 100 includes a first connection 132 and a second connection 134. When the first connection 132 receives a high-stage activation signal from a two-stage controller (e.g., system controller 20 in FIG. 1), the valve controller 130 is configured to control the input to coil 120 to move the valve member 122 to establish the high-capacity gas flow rate, and further configured to actuate the closure solenoid 148 to move the closure member 144 to an open position such that the high-capacity gas flow rate is communicated via the first and second opening ports 140, 142 to the outlet 105 of the valve unit 100.

Similarly, where valve unit 100 receives a pulse-width-modulated signal or the like that includes information indicative of an operating capacity level corresponding to an outlet pressure above 1 inch of water column, the valve controller 130 is configured to control input to the coil 120 to establish a high-capacity gas flow rate corresponding to the operating capacity level, and configured to actuate closure solenoid 148 to move closure member 144 to an open position such that the high-capacity gas flow is communicated via the first and second opening ports 140, 142 to the outlet 105.

Operation at Low-Capacity Gas Flow Rates

Where the valve unit 100 receives a pulse-width-modulated signal indicative of an operating capacity level corresponding to an outlet pressure below 1 inch of water column, the valve controller is configured to control input to the coil 120 and to deactivate closure solenoid 148 to move closure member 144 to a closed position against the first opening port 140, such that a low-capacity gas flow rate is communicated via only the second opening port 142 (or bypass orifice) to outlet 105. The opening area of the second opening port 142 is effective to establish a low-capacity gas flow rate that is maintained within a desired tolerance range.

Alternatively, when the valve unit 100 receives a low stage activation signal (e.g., a signal from a two-stage furnace controller received via connection 134), the valve controller 130 is configured to control input to the coil 120 and to deactivate closure solenoid 148 to move closure member 144 to a closed position against the first opening port 140. In this position, a low-capacity gas flow rate is communicated via the second opening port 142 to the outlet 105 as long as the low stage activation signal is present at the second connection 134.

Figure 5:
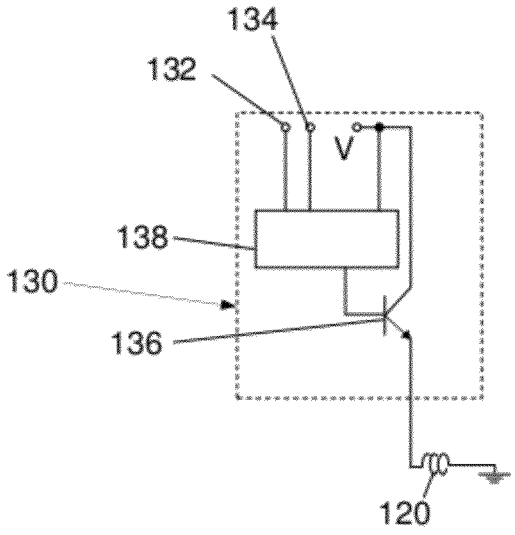
FIG. 5 shows a schematic diagram of a valve controller, according to the principles of the present disclosure.

Referring to FIG. 5, a schematic diagram of the valve controller 130 is provided. The valve controller 130 may comprise a microprocessor 138 that is in communication with the first connection 132 configured to receive a high-stage activation signal, and with the second connection 134 configured to receive a low-stage activation signal (from a heating system controller 20 that provides two-stage control). Alternatively, a pulse-width-modulation or other equivalent signal may be received, which signal indicates a desired operating capacity level. The microprocessor 138 may control a switching device 136 to controllably switch a voltage on an off to provide a pulse-width modulated voltage signal to a coil 120 (for either a solenoid or a stepper-motor), for controllably varying the gas flow rate of the valve. Alternatively, the microprocessor 138 may include pulse width modulation output that can directly control application of voltage to the coil 120.

Accordingly, the above embodiments of a valve unit 100 including a valve controller 130 that is connectable to and operable with a furnace system controller 20 that may be two-stage controller or a variable capacity furnace controller. The valve unit 100 including a valve controller 130 is configured to control a closure solenoid 148 for selectively moving the closure member 144 between an open position, in which a high-capacity gas flow rate is communicated via the first and second opening ports 140, 142 to an outlet 105, and a closed position against the first opening port 140, in which a low-capacity gas flow rate is communicated via only the second opening port 142 to the outlet 105 to thereby provide a consistent low capacity gas flow rate that is within a desired tolerance range. These and other advantages provide novel advantageous improvements over conventional two-stage gas valves.

Thus, it will be understood by those skilled in the art that the above described embodiments and combinations thereof may be employed in various types of heating systems with any combination of the above disclosed features, without implementing the others. It will be understood that the stepper motor driven gas valve and controller described above may be utilized in other forms of heating and cooling equipment, including water heater and boiler appliances. Accordingly, it should be understood that the disclosed embodiments, and variations thereof, may be employed without departing from the scope of the invention.

What is claimed is:

1. A valve unit for adjusting gas flow to a combustion apparatus, the valve unit comprising:

a valve member movable relative to a valve seat in response to a signal input to a coil, for modulating two flow rates of gas flowing through the valve unit to a combustion apparatus, the valve member selectively movable to establish and regulate flow rate pressures including a first desired outlet pressure corresponding to a high-capacity gas flow rate and a second desired outlet pressure corresponding to a low-capacity gas flow rate;

a first opening port;

a second opening port that is smaller than the first opening port;

a closure member that is movable between an open position, in which the high-capacity gas flow rate is communicated via at least the first opening port to at least one outlet, and a closed position against the first opening port, in which the low-capacity gas flow rate is communicated via only the second opening port to the at least one outlet; and a closure solenoid for selectively moving the closure member between the open position and closed position to selectively establish the high-capacity gas flow rate and/or the low capacity gas flow rate.

2. The valve unit of claim 1, wherein the at least one outlet comprises a first outlet for communication of the high capacity gas flow rate and a second outlet for communication of the low capacity gas flow rate.

3. The valve unit of claim 1, wherein the at least one outlet comprises a single outlet through which the high capacity gas flow rate and the low capacity gas flow rate are communicated.

4. The valve unit of claim 1, wherein the first opening port and the second opening port are disposed downstream of the valve seat.

5. The valve unit of claim 1, wherein the second opening port has an opening area in the range of between about 0.010 and about 0.100 inches$^2$ that is effective to provide the low capacity gas flow rate at a low outlet pressure of about 1.0 inch of water column or less.

6. The valve unit of claim 1, further comprising a flow adjustment member that is adjustable for varying the opening area of the second opening port, to enable adjustment of the low-capacity gas flow to the at least one outlet of the valve unit.

7. The valve unit of claim 6, wherein the second opening port has an opening area that is adjustable via the flow adjustment member to provide an outlet pressure in the range of about 0.2 to about 0.6 inches of water column, to thereby establish a desired low-capacity gas flow rate.

8. The valve unit of claim 1, further comprising a valve controller that is configured to control the signal that is input to the coil to adjust the gas flow rate through the valve seat to a desired gas flow rate.

9. The valve unit of claim 8, wherein the valve controller controls movement of the valve member to vary an opening area relative to the valve seat based on a magnetic field generated by the coil, which is dependent on an input signal applied to the coil.

10. The valve unit of claim 1, wherein the coil is part of a stepper-motor that displaces the valve member based on an input signal applied to the stepper-motor coil.

11. The valve unit of claim 1, wherein the coil is a solenoid coil that is configured to move the valve member to vary the high-capacity gas flow rate based on the generated magnetic field that is dependent on an input voltage applied to the solenoid coil.

12. The valve unit of claim 1, wherein the valve member is configured to directly vary an opening relative to the valve seat to vary the high-capacity gas flow rate, without any mechanical linkage to a diaphragm.

13. A valve unit for adjusting gas flow to a combustion apparatus, the valve unit comprising:

a valve member that moves relative to a valve seat in response to a signal input to a coil, for modulating two flow rates of gas flowing through the valve unit to a combustion apparatus, the valve member selectively movable to establish and regulate flow rate pressures including a first desired outlet pressure corresponding to a high-capacity gas flow rate and a second desired outlet pressure corresponding to a low-capacity gas flow rate;

a first opening port;

a second opening port that is smaller than the first opening port, the first and second opening ports being disposed downstream of the valve seat;

a closure member that is movable between an open position, in which the high-capacity gas flow rate is communicated via at least the first opening port to an outlet, and a closed position against the first opening port, in which the low-capacity gas flow rate is communicated via only the second opening port to the outlet, a closure solenoid for selectively moving the closure member between the open position and closed position to selectively establish the high-capacity gas flow rate and/or the low capacity gas flow rate; and an adjustable member that is adjustable for varying the opening area of the second opening port, to enable adjustment of the low-capacity gas flow to the outlet of the valve unit.

14. The valve unit of claim 13, wherein the second opening port has an opening area in the range of between about 0.010 and about 0.100 inches$^2$ that is effective to provide the low capacity gas flow rate at a low outlet pressure of about 1.0 inch of water column or less.

15. The valve unit of claim 13, wherein the second opening port has an opening area that is adjustable to provide an outlet pressure in the range of about 0.2 to about 0.6 inches of water column, to thereby establish a desired low-capacity gas flow rate.

16. The valve unit of claim 13, further comprising a valve controller that is configured to control the signal that is input to the coil to adjust the gas flow rate through the valve seat to a desired gas flow rate.

17. The valve unit of claim 13, wherein the valve member is configured to move to vary the opening area relative to the valve seat based on the magnetic field generated by the coil, which is dependent on an input signal applied to the coil.

18. The valve unit of claim 13, wherein the coil is part of a stepper-motor that displaces the valve member based on an input signal applied to the stepper-motor coil.

19. The valve unit of claim 13, wherein the valve member is configured to displace a diaphragm to vary the gas flow rates through the valve unit.

20. The valve unit of claim 13, wherein the coil is a solenoid coil that is configured to move the valve member to vary the high-capacity gas flow rate based on the generated magnetic field that is dependent on an input voltage applied to the solenoid coil.

21. The valve unit of claim 20, wherein the valve member is configured to directly vary an opening relative to the valve seat to vary the high-capacity gas flow rate, without any mechanical linkage to a diaphragm.

22. The valve unit of claim 13, wherein the signal input to the coil is based in part on an activation signal that is indicative of a desired operating capacity level.

* * * * *